United States Patent [19]

Reed

[11] 4,120,637

[45] Oct. 17, 1978

[54] HOT WATER SPRAY INJECTION FOR SMOKE SUPPRESSION IN FLARES

[75] Inventor: Robert D. Reed, Tulsa, Okla.

[73] Assignee: John Zink Company, Tulsa, Okla.

[21] Appl. No.: 735,625

[22] Filed: Oct. 26, 1976

[51] Int. Cl.[2] ..... F23G 7/06

[52] U.S. Cl. ..... 431/5; 431/12; 431/89; 431/202

[58] Field of Search ..... 431/4, 5, 202, 11, 12, 431/190, 89, 210; 60/39.05; 23/277 C

[56] References Cited

U.S. PATENT DOCUMENTS

| | | | |
|---|---|---|---|
| 2,889,002 | 6/1959 | Kocee | 431/5 |
| 3,162,236 | 12/1964 | Williams | 431/202 |
| 3,195,608 | 7/1965 | Voorheis et al. | 431/5 X |
| 3,273,627 | 9/1966 | Zink et al. | 431/202 |
| 3,892,519 | 7/1975 | Reed et al. | 431/202 |
| 3,973,899 | 8/1976 | Reed et al. | 431/5 |

FOREIGN PATENT DOCUMENTS

| | | | |
|---|---|---|---|
| 1,246,239 | 9/1971 | United Kingdom | 431/5 |

*Primary Examiner*—Edward G. Favors
*Attorney, Agent, or Firm*—Head, Johnson & Chafin

[57] ABSTRACT

Apparatus for smoke suppression in the burning of waste gases in flare stack, comprising a conduit means through which waste gases are flowed, under pressure, to a flare stack; a source of hot water in the range of 200° to 250° F. in temperature, or higher, and a plurality of spray nozzles for spraying the hot water, in the form of cones of fine droplets of water, which by their high velocity thoroughly mix with the flowing waste gas, and provide a water vapor content mixed with the waste gases in the range of at least 6% mole percent, or more. Means are provided for control of the rate of flow of hot water dependent on the temperature of the water and dependent upon, at least, the mass flow rate of waste gases to the flare.

10 Claims, 5 Drawing Figures

HOT WATER SPRAY INJECTION FOR SMOKE SUPPRESSION IN FLARES

CROSS-REFERENCES TO RELATED PATENT

This application is related to the U.S. Pat. No. 3,973,899 entitled Apparatus For Using Exhaust Steam For Smoke Suppression In Flares. This patent was issued Aug. 10, 1976.

BACKGROUND OF THE INVENTION

1. Field of the Invention

This invention lies in the field of the flaring of waste gases by burning at the top of the flare stack in such a manner as to provide smokeless combustion, with minimum pollutants going into the atmosphere.

This invention further lies in the use of hot water to provide a mixture of water vapor with the flowing waste gases, upstream of the burning point at the top of the flare.

2. Description of the Prior Art

It is well known in smokeless combustion of hydrocarbon gases, if there is mixed with the flowing gases a sufficiently high mol percent of water vapor, that in the heat of the burning zone there will be a chemical reaction which converts methane and water into carbon monoxide and hydrogen, the burning of which provide smokeless combustion. If there is sufficient mixture of water vapor, and if the flame is hot enough to carry out the chemical reactions, there will be smokeless combustion.

This chemical reaction requires that the water be in the vapor phase, and also be of adequate mol percentage, or partial pressure of water vapor, to permit the water vapor-hydrogen chemistry to occur to a great enough degree. The function of water vapor mol percentage in gases is according to the saturation temperature, and the amount of water vapor as contained by gases as a function of temperature is as follows:

60° F. — 1.75%
70° F. — 2.75%
80° F. — 3.60%
90° F. — 4.90%
100° F. — 6.45%
120° F. — 11.50%

The water vapor contents as shown, are for a condition of saturation at each temperature. In each case, if the temperature should fall the contained water vapor will reach its dew-point, and condense as liquid water, and the residual water vapor would be that for the lower temperature.

This process, in which the chemistry indicated above provides useful smoke reduction, is brought about by the water vapor mixed with the hydrocarbon gases. Therefore, the temperature of the gas-water vapor mixture is a key to accomplishment of the desired chemical reaction. Further, this reaction requires the supply of heat from combustion, of approximately 90,000 btu/-mol. This is supplied by the flame itself. However, in the practice of smoke suppression, a full molar reaction is not required. Most hydrocarbons in burning in the atmosphere show marked smoke reduction, when as little as 3% water vapor is contained in the hydrocarbon, as it begins to burn. Of course, higher water vapor mol percent is preferable. This is true because flare vented hydrocarbons are normally "bone dry", such that water vapor content is typically measured in parts per million.

From the water vapor-mol percent data as shown above, it is evident that the effect of water vapor in flare vented gases begins to occur when the gas water vapor mixture discharged for burning is as warm as is possible. Since gases enroute to the flare are frequently at lower temperature, some means for heat supply to the mixture must be provided.

SUMMARY OF THE INVENTION

It is a primary object of this invention to provide apparatus for supplying water vapor, intimately mixed with a stream of flowing waste gases for burning in a flare tower.

It is a further object of this invention to provide the water vapor, and the heat necessary, to raise the temperature of the gases to a temperature sufficient to provide a mol percentage of water vapor mixture sufficient to carry out the burning chemistry for smokeless combustion.

It is further an object of this invention to provide hot water sprayed as a fine mist, from a plurality of nozzles into the flowing gas stream, to provide the necessary heat and water vapor, to maintain a desired water vapor content in the gas stream to the burning front.

These and other objects are realized and the limitations of the prior art are overcome in this invention, by directing the flowing stream of waste gas through a conduit upstream of the burning front of the flare tower, and to inject a stream of hot water through a plurality of spray nozzles, in the form of cones of fine droplets, to throughly mix with the gas stream, to evaporate, to heat the gas molecules to as high a temperature as possible, and to saturate the gas to as high a mol percentage of water vapor, as is possible with the temperature of the hot water available.

A further portion of this invention involves creating such a fine spray of water that the water droplets are entrained in the gas flow and will flow with the gas to the burning zone where they are evaporated in the flame zone creating a still higher mol percentage of water vapor.

A further part of this invention is to control the rate of flow of hot water as a function of the rate of flow of waste gases, as a function of the temperature of the waste gases, as a function of the water vapor content of the waste gases, and also as a function of the temperature of the hot water that is sprayed into the conduit.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
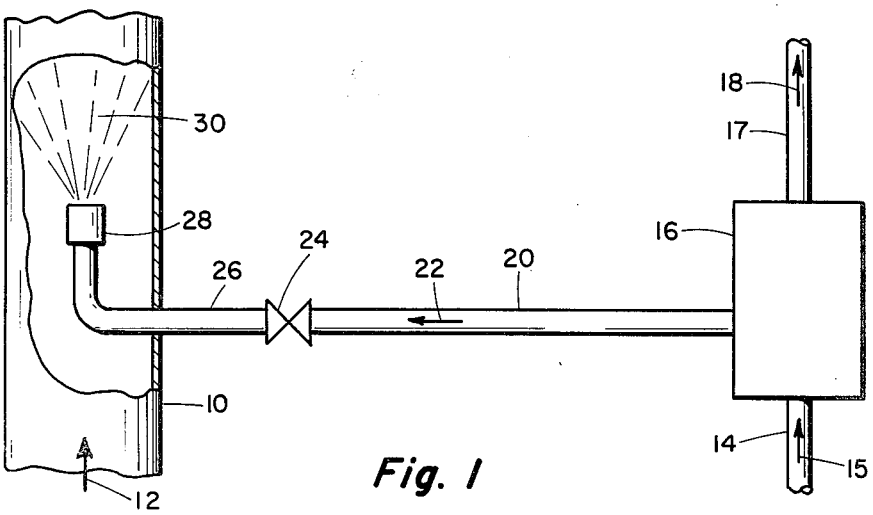
FIG. 1 is an overall view of the system.

Referring to the drawings, and in particular to FIG. 1, there is shown one embodiment of the apparatus of this invention. A source of waste gases provides a flow into and through a conduit 10 in accordance with arrow 12, of the waste gases enroute to a flare tower, and to a burning zone at the downstream end thereof, as is well known in the art. There is a source of low pressure steam in pipe 14, indicated and flowing in accordance with the arrow 15.

Means are provided, such as separator 16, for example, which separates the incoming low pressure steam plus condensate 15, into dry steam flowing in accordance with arrow 18 in an outlet pipe 17, and a stream of hot water flowing in accordance with arrow 22 through a pipe 20, to a control means or valve 24, and then through a pipe 26 to one, or a plurality of, water flow nozzles 28, which because of the pressure of the steam in the separator 16, or because of additional pressure provided by pump means in the water line 20 (not shown), provide sufficient velocity of water through the nozzle 28, to make a very fine spray in the form of a cone 30 of fine water droplets, which intermix with the flowing waste gases. The hot water droplets in contact with the gases, which are normally bone dry, evaporate to provide a saturation percentage of water vapor with the gas, at the corresponding temperature of the water droplets-gas-water mixture.

Figure 3:
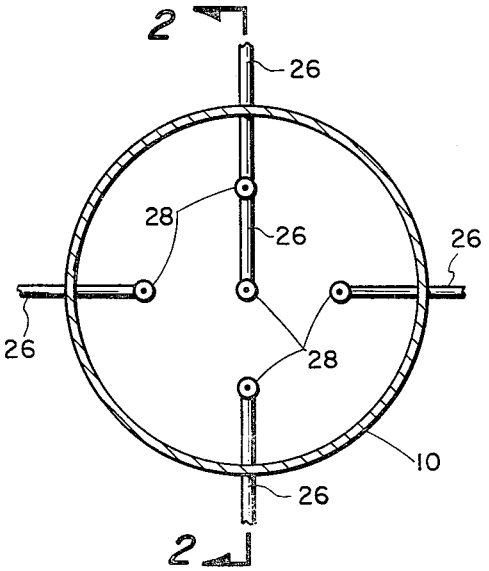
FIGS. 2 and 3 indicate in plan and elevation sections, one embodiment, in which the water spray nozzles provide an axial flow of water droplets.
Figure 2:
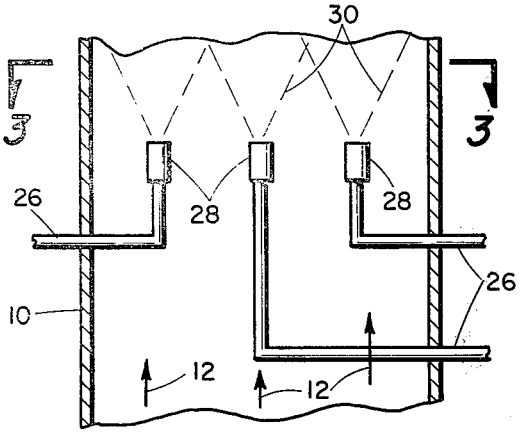

Referring now to FIGS. 2 and 3, there is shown in FIG. 2 a vertical section of the conduit 10 taken in the plane 2—2 of FIG. 3, in which a plurality of pipes 26 enter through the wall of the pipe 10. Each pipe 26 carries a spray nozzle 28, directed axially, to spray cones of fine droplets of hot water 30, to mix with the waste gases which are flowing axially in accordance with the arrows 12.

As shown in FIG. 3, which is a horizontal section taken along the plane 3—3 of FIG. 2, the plurality of nozzles are arranged more or less equally spaced across the cross-section, so that the plurality of spray cones thoroughly mix with the full cross-section of gas in the conduit 10.

Figure 5:
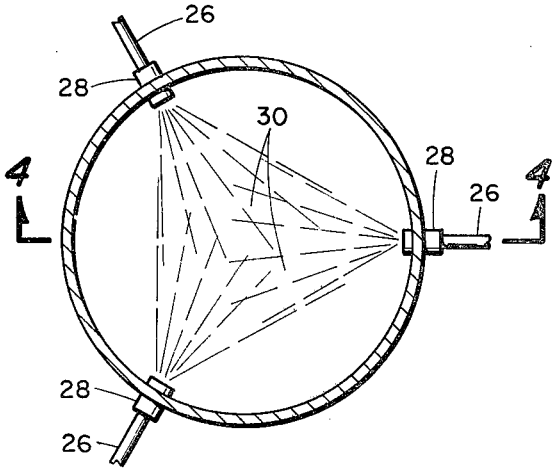
FIGS. 4 and 5 show in plan and elevation sections, an alternate embodiment, in which a plurality of nozzles provide a transverse flow of water droplets into the gas stream.
Figure 4:
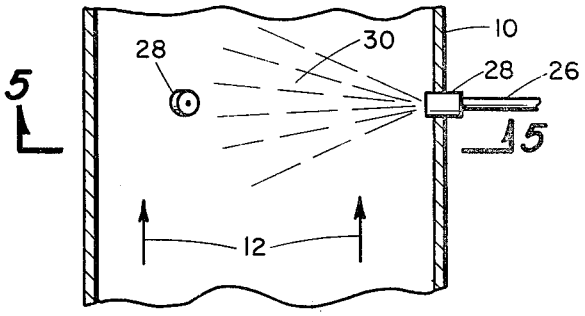

Referring now to FIGS. 4 and 5, there is shown in FIG. 4 a vertical cross-section of the conduit 10 which is taken across the plane 4—4 of FIG. 5. There are a plurality of nozzles 28 arranged in a perpendicular plane, and circumferentially equally spaced as shown in FIG. 5. These nozzles create cones of fine droplets which move at high velocity across the conduit 10, perpendicular to the flow of waste gases, as indicated by the arrows 12. This turbulent flow of water droplets thoroughly mixes with the waste gases.

The water must be of sufficient temperature so as to provide a final temperature of at least 80° for the resulting mixture of water droplets and gas in the flowing stream. If the waste gases are of lower temperature, they will have to be heated by contact with the water droplets. Thus, the entering water must be of a higher temperature and probably of a minimum temperature of 80° to 100° F.

Also, since the flare gases are normally quite dry, there will be evaporation from the water droplets, which will cause further cooling. Thus, there is further need of as high a temperature as possible of the entering water.

From the water vapor mol percentage data as shown above, it is evident that the recited effect of water vapor in flare vented gases begins to occur when the gas water vapor mixture after injection of water is as warm as possible. Since gases enroute to the flare are frequently of low temperature, some means of heat supply to the mixture must be provided, and this is provided as latent heat of the water itself, as it is sprayed into and mixed with the gases.

The heat source lies in the heated water, as distinguished from steam, which is commonly used in prior art systems. The heated water can be sprayed into and brought in contact with the flowing flare gases in any convenient way such as is shown in the drawings. Other means of contacting the water and cool gases, is in a countercurrent gas-water flow contact tower, such as a bubble tower, based on many well known designs for such towers. Or the gas can be simply bubbled through hot water contained in a suitable closed vessel. In any event, heat will be transferred from the hot water to the flowing gases to increase their temperature, and through gas water contact, to cause the gas as discharged to be saturated with water vapor at the elevated gas temperature, and thus to increase the water vapor content of the higher temperature-water vapor mixture.

It is preferable that the water used be at a temperature of 200° F. or more, in order to supply sufficient heat to the gas water vapor mixture. Such a supply is readily available as condensate within an exhaust steam system, where the condensate can be removed from the exhaust steam in any of several well known ways, and separately piped to the gas-hot water contacting means, as illustrated in the drawings.

When the exhaust steam system is operating at say 10 psi gauge, the separated water will at approximately 238° F., but if the exhaust steam is operating at 20 psi gauge, the separated water will be at 258° F. approximately, and no means for heating the water will be required in any case. Operating pressure in an exhaust steam system is typically 10% of the live steam pressure supplied to devices for exhaust steam collection, and 150 psi gauge is a typical live steam supply pressure. In this case, the water temperature will be approximately 249° F. Also in each case, the exhaust steam pressure would supply the pressure which would be required for spraying the hot water into the flare system gases. However, if means for preheating cold water are present, a cold water supply at adequate pressure may be used.

It is to be clearly understood that the hot water contact with gases to be flared is not necessarily the sole means for smoke suppression available in the flaring of the gases. There are other ways of aiding in the smoke suppression such as the injection of live steam, or of low pressure steam, as in U.S. Pat. No. 3,973,899, and other ways. Consequently, to the extent that hot water is available and has heat content sufficient to provide some warming of the gases and provide some water vapor to the mixture, to that extent the energy in the hot water can be utilized for smoke suppression. If that energy is not enough to provide the full suppression, then other sources of energy can be used in addition.

Any water vapor added in the form of the hot water will be cost free, and reduces the demand for expensive, and fuel wasteful, further smoke suppressive means, such as the use of live steam injection at the burning zone, as is typical in the prior art. Since the flare gases are customarily "bone dry" as they flow to the flare tower and the addition of any water vapor to them aids in smoke suppression. It is also true that the temperature of the flare system gases at approach to water contact may be at temperatures equal to or well above 200° F. which can be considered as beneficial to the water vapor retention after contact with hot water as recited. It may be said that gas temperature at approach to water contact is not critical to the effect of addition of water vapor to the flowing gas.

The means for gas water contact is not a critical factor in this invention, but the appratus illustrated in the drawings are preferred forms for gas water contact prior to gas burning in the open air, and at some distance downstream of the point of injection of water. The distance from the burning point factor is considered accomplished, if the mixing device illustrated in the drawing is in the vicinity of the base of the flare stack, or incorporated into the vertical riser from grade to the flare, at some point near its face, for best results in smoke suppression. However, the gas-water contact device can be located immediately upstream from the burning point for appreciable suppression of smoke.

Since hot water spray injection needs reasonable control of water quantity injected, in accordance with gas quantity, the control valve 24 is provided. This control may take the form of any of a number of well known forms, which may be automatic or manual. In any case, the use of gas flow measurement devices and water flow measurement devices, and temperature measuring means in the gas flow section upstream of the point of injection, downstream of the point of injection, and in the water line, are beneficial in adjusting the control means in accordance with the flow conditions.

It will be clear also that if the spray of water into the conduit forms relatively large drops, which will fall in a rising column of gas, then such water is used simply as a means to heat the gas flowing past it and in vaporizing to the extent that it provides a flow of saturated gas. However, if the water injection means provides a sufficiently small size of water droplets, these may be carried along with the flow of gas and will, in flowing into the burning zone, be evaporated and provide a still higher mol percentage of water vapor, than was in the saturated gas just prior to entering the burning zone.

It is therefore an additional object to this invention to provide an injection means which produces a flow of very fine droplets, such that will flow along with the column of gas, rather than falling down through the column of gas, and thus be carried by the gas flow into the burning zone, where they are evaporated to form a higher mol percentage of water vapor.

What has been described as a system for the utilization of hot water in the temperature ranges of 100° F. or higher, (preferably in the range of 250° F. or higher) which can be injected in the form of very fine droplets of water, into a flowing stream of dry waste gases flowing toward a flare tower. The flow of droplets is at high velocity, which may be due to the pressure of the low pressure steam from which the water is a condensate, or it may be due to the pressure of an additional pumping means. This high velocity creates a turbulence in which the water droplets are thoroughly mixed with the gas molecules, and evaporated to the point where the resulting mixture reaches a combination temperature, and a saturation of water vapor. The mol percentage of water vapor will be a function of this resulting temperature. If the temperature of the waste gases is low it will be desirable to increase the rate of flow of hot water in order to maintain a sufficiently high resultant temperature, and therefore a sufficiently high mol percentage. The rate of flow of water can also be determined by the rate of flow of gas, so that when the rate of gas flow is high, the water rate will be proportionately high, and so on. It is clear also that the finer the size of the droplets sprayed into the waste gases, the proportion of the total water injected that moves along with the gases into the flame zone will be greater, and therefore the amount of water vapor produced in the flame zone will be greater, and therefore will provide a more beneficial chemistry, toward the end that the flame will be smokeless.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. Apparatus for utilizing hot water for smoke suppression in flares for vented hydrocarbons, comprising;

(a) conduit means for the flow of waste gases to a flare for burning in the atmosphere;

(b) means to supply hot water under pressure to a plurality of nozzles within said conduit means;

whereby said hot water will be sprayed in cones of fine water droplets, at high velocity, into said flow of waste gases to thoroughly turbulently mix therewith;

whereby said mixture of water droplets, and gas will reach a selected resultant temperature, in which said gas will be saturated at said temperature; and (c) control means to control the rate of flow of hot water responsive at least to the rate of mass flow of waste gases; and wherein the temperature of said water is at least 150° F.

2. The apparatus as in claim 1 in which said plurality of nozzles direct the injected droplets in an axial direction, co-directional with said waste gases.

3. The apparatus as in claim 1 in which said plurality of nozzles are in a transverse plane and said spray is directed radially in said transverse plane.

4. The apparatus as in claim 1 in which the temperature of said hot water is at least 250° F.

5. The apparatus as in claim 1 in which the temperature of said hot water is at least 200° F.

6. The apparatus as in claim 1 in which said conduit is upstream of the base of said flare stack.

7. The apparatus as in claim 1 in which said conduit is part of said flare stack, and in which the point of injection of water is upstream of the burning zone.

8. The apparatus as in claim 1 in which said waste gases are dry prior to injection, and a high rate of flow of hot water is provided to saturate said gases.

9. The apparatus as in claim 1 in which the temperature of said waste gases is low prior to injection, and a high rate of flow of hot water is provided to heat said gases to as high a resultant temperature as possible.

10. In an apparatus for burning hydrocarbon gases in a flare stack, the method of smoke suppression comprising the steps of:

(a) providing hot water at a temperature of at least 150° F.;

(b) injecting said water in the form of fine droplets at high velocity into the gas flowing to the burner at the top of a flare stack, in such quantity, dependent upon the flow rate of the gas, such that the admixture of the hot water droplets with the gas will provide a saturated gas at a selected resultant temperature.

* * * * *